US008378813B2

(12) United States Patent
Bannard

(10) Patent No.: US 8,378,813 B2
(45) Date of Patent: Feb. 19, 2013

(54) PERSONNEL TRACKING SYSTEM

(76) Inventor: Kenneth R. Bannard, Drayton Valley (CA)

( * ) Notice: Subject to any disclaimer, the term of this patent is extended or adjusted under 35 U.S.C. 154(b) by 482 days.

(21) Appl. No.: 12/636,278

(22) Filed: Dec. 11, 2009

(65) Prior Publication Data

US 2011/0121964 A1 May 26, 2011

(30) Foreign Application Priority Data

Nov. 24, 2009 (CA) ..... 2686037

(51) Int. Cl.
*G08B 1/08* (2006.01)

(52) U.S. Cl. ..... 340/539.13; 340/539.22; 340/5.21; 340/10.1; 340/10.4; 340/572.1; 340/572.4; 340/572.7; 235/380; 235/383; 235/385; 235/451; 235/492

(58) Field of Classification Search ..... 340/539.13, 340/539.22, 5.21, 10.1, 10.4, 572.1–572.7; 235/380, 383, 385, 451, 492
See application file for complete search history.

(56) References Cited

U.S. PATENT DOCUMENTS

| | | | | |
|---|---|---|---|---|
| 6,983,202 | B2 | 1/2006 | Sanqunetti | |
| 7,366,522 | B2 | 4/2008 | Thomas | |
| 7,493,211 | B2 | 2/2009 | Breen | |
| 7,498,985 | B1 | 3/2009 | Woo | |
| 2001/0052849 | A1 | 12/2001 | Jones, Jr. | |
| 2006/0229928 | A1 * | 10/2006 | Nix, Jr. | 705/9 |
| 2007/0176771 | A1 | 8/2007 | Doyle | |
| 2008/0097687 | A1 | 4/2008 | Naden | |
| 2008/0125964 | A1 | 5/2008 | Carani | |
| 2008/0125965 | A1 * | 5/2008 | Carani et al. | 701/207 |
| 2008/0238769 | A1 | 10/2008 | Verechtchiagine | |
| 2010/0013639 | A1 * | 1/2010 | Revert | 340/572.1 |

OTHER PUBLICATIONS

"Vehicle Monitoring System (VMS)," Mobiltex: Wireless Data Solutions, © 2011 Mobiltex Data Ltd., Calgary, Canada, <http://www.mobiltex.com/products/vms/. . . html> [retrieved Feb. 17, 2011], 9 pages.

* cited by examiner

*Primary Examiner* — Tai T Nguyen
(74) *Attorney, Agent, or Firm* — Christensen O'Connor Johnson Kindness PLLC

(57) ABSTRACT

Disclosed is a tracking and Geofencing system. Zones are classified into three types: safe, hazardous and travel, with the travel zone being defined in the preferred embodiment as any territory not in a safe or hazardous zone. The system monitors an asset by determining whether the asset is within a safe zone, logging data as to when the asset arrives in or leaves the safe zone and at what time it did so, while in transit from the safe zone to a hazardous zone logging the route of travel which may vary from day to day and notifying the owner if the asset goes motionless while in route for a user defined period of time, logging data as to when the asset arrives and leaves a hazardous zone such as time and duration and alerting the owner if the asset has exceeded a predetermined time within a hazardous zone.

7 Claims, 13 Drawing Sheets

PERSONNEL TRACKING SYSTEM

TECHNICAL FIELD

Personnel tracking system

BACKGROUND

Modern GPS and other position determination techniques, communications, and information processing have enabled sophisticated position tracking systems.

For example, Thomas (U.S. Pat. No. 7,366,522) discloses a position monitoring system that displays position information via a web server.

Some tracking systems use the technique of geofencing.

Geofencing is the establishment of a predetermined boundary such that different actions are taken depending on whether a position is determined to be inside or outside of the boundary.

Jones (US patent application 2001/0052849) discloses a system that notifies a server if a stored boundary rule set is breached.

Tracking systems and geofencing are useful for a variety of purposes. Most systems relate to security applications or logistics but there is also a need for tracking and geofencing for safety purposes.

In addition, existing geofencing applications classify zones in a binary (allowed/excluded) fashion which is unsuitable for an application tracking assets that may be off duty, in transit or at a work site and for which different treatment is required for each kind of area.

SUMMARY

In order to serve the purposes of tracking assets and developing a best practice to monitor the asset, there is disclosed a tracking and geofencing system and method that targets the lone worker (asset). In an embodiment, territory is classified into zones of three types: safe, hazardous and travel, with the travel zone being defined in the preferred embodiment as any territory not in a safe or hazardous zone. The system and method in an embodiment monitors the asset by determining whether the asset is within a safe zone, logging data as to when the asset arrives in or leaves the safe zone and at what time it did so, while in transit from the safe zone to a hazardous zone logging the route of travel which may vary from day to day and notifying the owner if the asset goes motionless while in route for a user defined period of time, logging data as to when the asset arrives and leaves a hazardous zone such as time and duration and alerting the owner if the asset has exceeded a predetermined time within a hazardous zone.

According to an embodiment of a tracking method there is disclosed a method of configuring a tracking system with one or more tracking devices each associated with an asset, comprising the steps of: defining at least a region of a first type; defining at least a region of a second type; and defining at least a region of a third type. In an embodiment, there is also provided configuring the tracking system to treat each type of region differently. In a further embodiment, there is also provided configuring the tracking system to initiate an alarm if a tracking device associated with an asset remains within a region of the second type for a time exceeding a first preset time duration; and configuring the tracking system to perform a function if a tracking device associated with an asset is within a region of the third type, the function being one of the class of functions consisting of: initiating an alarm if the tracking device remains stationary within the region for a time exceeding a second preset time duration; and tracking the route of travel of the tracking device while it remains within the region. In a further embodiment, there is provided configuring the tracking system to perform a first function relating to the second type of region, the first function being one of the class of functions consisting of initiating an alarm if a tracking device associated with an asset remains within a region of the second type for a time exceeding a first preset time duration; and logging the total number of tracking devices each associated with an asset in a zone of the second type; and configuring the tracking system to perform a second function relating to the third type of region, the second function being one of the class of functions consisting of initiating an alarm if a tracking device associated with an asset remains stationary within a region of the third type for a time exceeding a second preset time duration; and tracking the route of travel of a tracking device while it remains within a region of the third type.

In a further embodiment, there is disclosed a method of configuring a tracking system with one or more tracking devices each associated with an asset, comprising the steps of: defining at least a region of one type; and configuring the tracking system to log the number of tracking devices within a region of the one type each associated with an asset.

Systems for carrying out the various embodiments of the methods are also disclosed.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
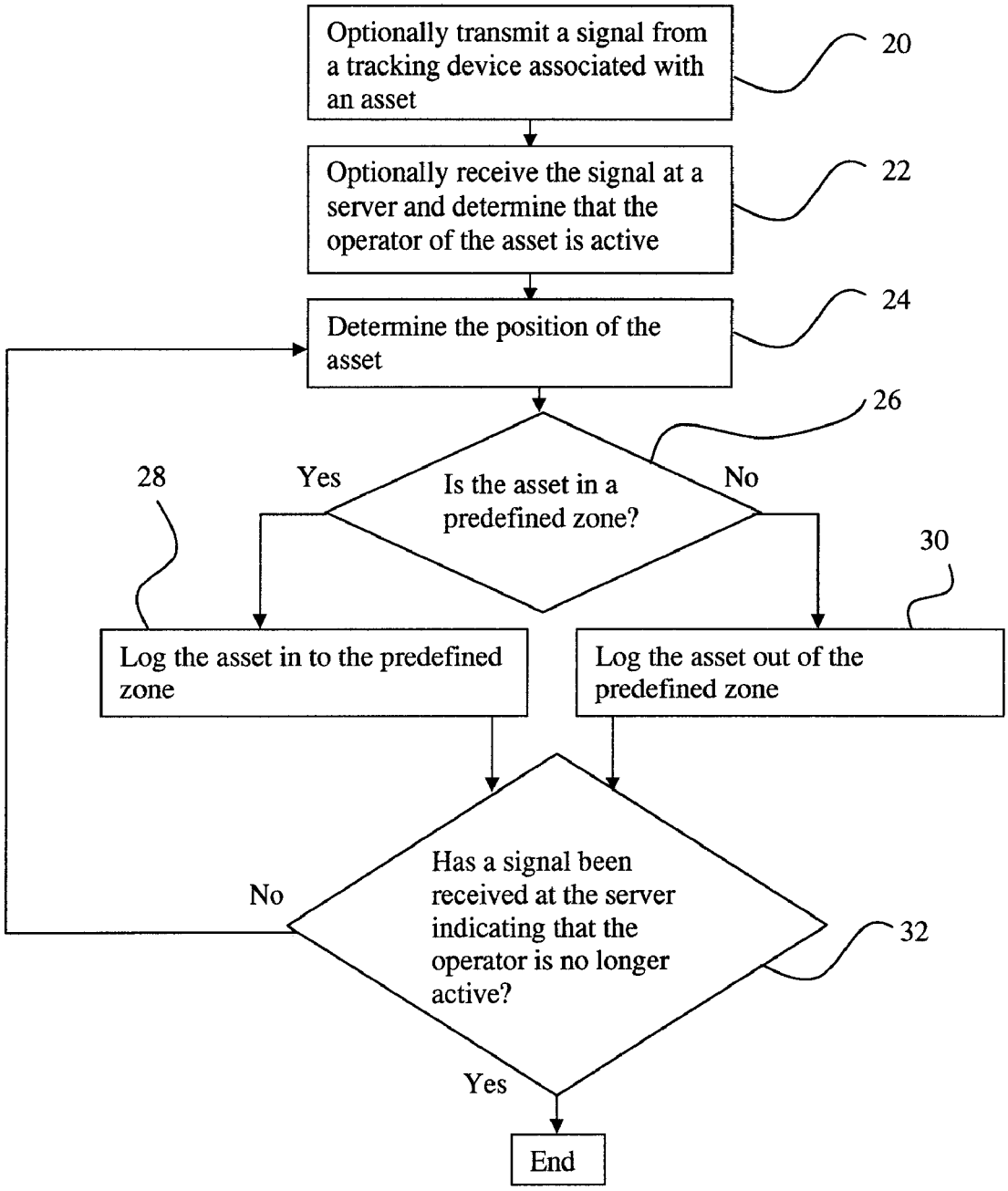
FIG. 1 is a flow chart showing the process of automatic log in/out tracking.

A preferred embodiment uses a GPS device to automatically log movements of field personal in and out of predetermined locations.

Some definitions used in the description of the preferred embodiment are as follows:

Tracking device—a device used to determine a position, in an embodiment the tracking device may be a GPS transponder such as the SPoT system disclosed here TRACK mode—in an embodiment in which SPoT is used as a tracking device, a GPS position signal is received from SPoT at 10 minute intervals, push OK/check button for 5 seconds to enter TRACK mode. Tracks for a 24 hr period.

OK mode—in an embodiment in which SPoT is used as a tracking device, a GPS position signal is sent from SPoT manually, push OK/check button for one second to send an OK mode signal.

HELP mode—in an embodiment in which SPoT is used as a tracking device, a GPS position signal is sent from SPoT manually, push HELP button for one second to enter HELP mode.

911 mode—in an embodiment in which SPoT is used as a tracking device, a GPS position signal is sent from SPoT manually. Activates emergency response procedure. Push the 911 button to enter 911 mode.

Location—legal land description (LSD).

GPS Location—one specific Longitude/Latitude GPS coordinate relating to a single location.

Geofence—area surrounding a GPS location which defines the location's geographic boundary.

Operator—Person carrying a tracking device or operating an asset with a tracking device.

Supervisor—Person monitoring the FPMI host PC

Host—FPMI PC application supervised at a central location

Server—forwards data between the tracking devices and the host

Asset—typically defined as a person(s) and vehicle combination. This term is applicable to an individual or piece of equipment that has a GPS transmitter affixed to it. Industry standard term "lone-worker".

Owner—individual or corporation to which the asset belongs

Safe zone Geofence—generally areas in which a mobile asset is considered to be off duty, and may include areas such as:

a. Rural residence, Geofence in this scenario would consist of coordinates outlining the boundary of a farm for example.

b. Urban communities, Geofence that would outline the boundary of a town or city to which the assets may reside.

c. Owner defined areas such as manned or unmanned production facilities in which assets are monitored.

Hazardous zone Geofence—areas of specific interest to the owner in that they pose potential threats to the asset due to the inherent nature of the location due to the potential of;

a. release of hazardous gases, vapors or liquids b. personal injury c. limited accessibility d. lack of conventional communication (cell phone coverage etc.)

Travel zone—areas between safe zones and hazardous zones.

Although the preferred embodiment is primarily directed towards industrial applications, other applications to which the system can be applied include:

Ski hills where patrons wearing the transmitter could be automatically detected as being in "out of bound" areas or enable parents to be able to locate their children if separated.

Outdoor enthusiast that if detected as being motionless for an extended period of time could have an automated notification sent to persons of concern, hunters, snowmobilers etc.

Figure 13:
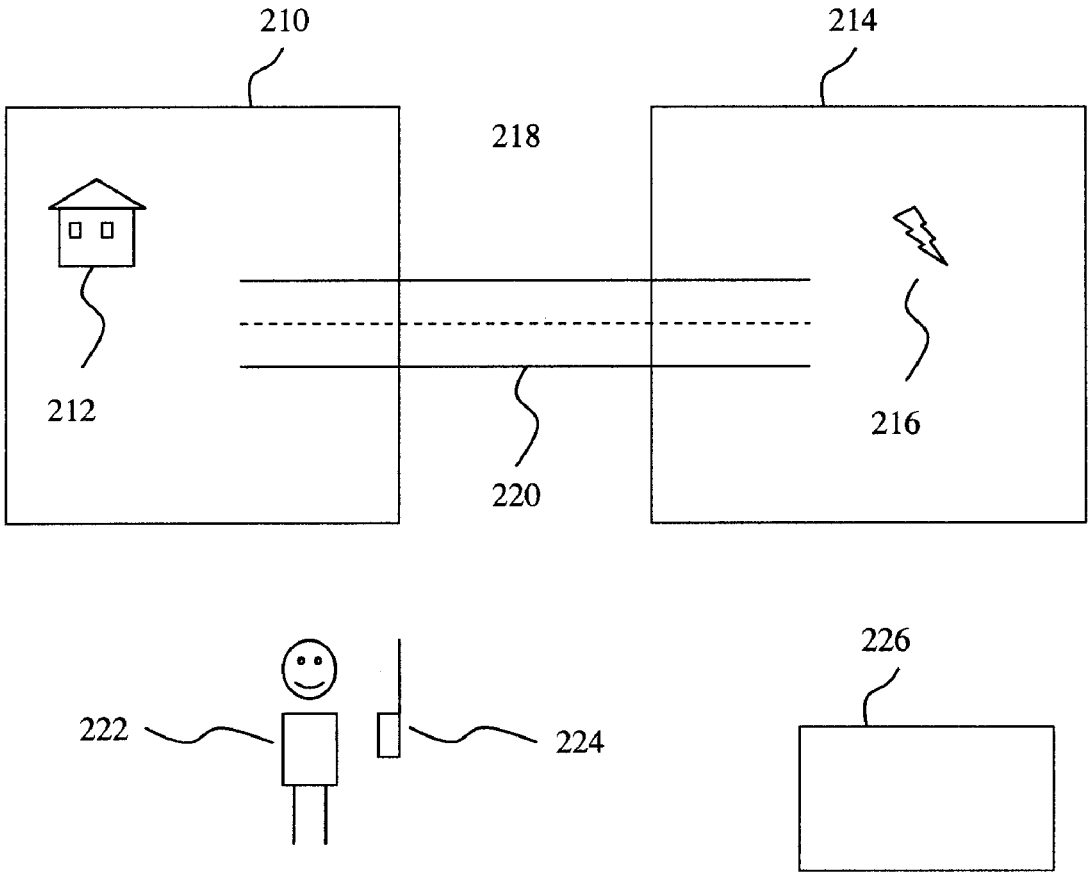
FIG. 13 is a schematic diagram of a tracking system showing three zones and an operator with a tracking device

Referring to FIG. 13, three zones are shown, a safe zone 210 including in this case a residence 212, a hazardous zone 214 containing hazard 216, and a travel zone 218 comprising all territory not in the safe zone and hazardous zone, and including pathway or pathways 220 extending between the safe zone and hazardous zone through the travel zone. Pathway or pathways 220 may for example be a road or roads or a pathway or pathways permitting walking or commuter traffic via all terrain vehicles Also shown is operator 222 with tracking device 224. The tracking device is capable of wireless communications, and communicates directly or indirectly with computing system 226. In the preferred embodiment the computing system comprises two general purpose computers connected by the internet. Depending on the embodiment a single general purpose computer may be used, or a specialized computer or computers may be used. It is unimportant in what zone the computing system is located, and depending on the embodiment components of the computing system may be spread over multiple zones.

Figure 14:
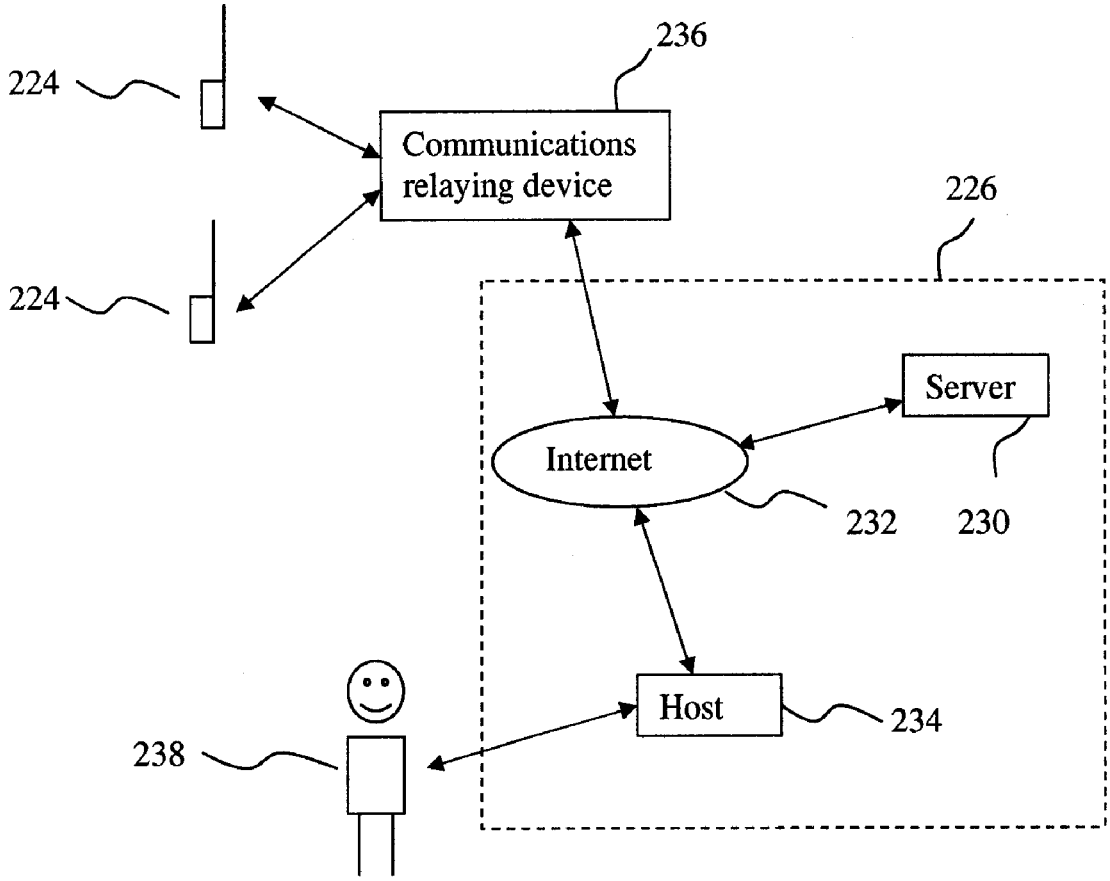
FIG. 14 is a schematic diagram showing the connections between different parts of the system in an embodiment FIGS. 15A, 15B, 15C and 15D together are a flow chart showing the operation of an embodiment of the system.

Referring to FIG. 14, in the preferred embodiment the computing system 226 comprises server 230, a general purpose computer, which communicates with one or more tracking devices 224. The server in this embodiment receives position information from the tracking device or devices and compares it to a database of zone definitions to determine what zone a tracking device is in, and sends messages when appropriate to an operator or operators, and to emergency responders. In communication with the server over the internet 232 is host 234, also a general purpose computer. Depending on the embodiment communication between the server and tracking devices may be relayed through communication relaying device 236 connected to the server via the internet. Communication between the relaying device and the tracking devices may be wireless or may be via a further relaying device or relaying devices in wireless communication with the tracking device or tracking devices. The host communicates with supervisor 238, producing reports for the supervisor and receiving input from the supervisor. The communication between the host and supervisor may be via an ordinary computer interface such as one comprising a screen and keyboard.

Figure 7:
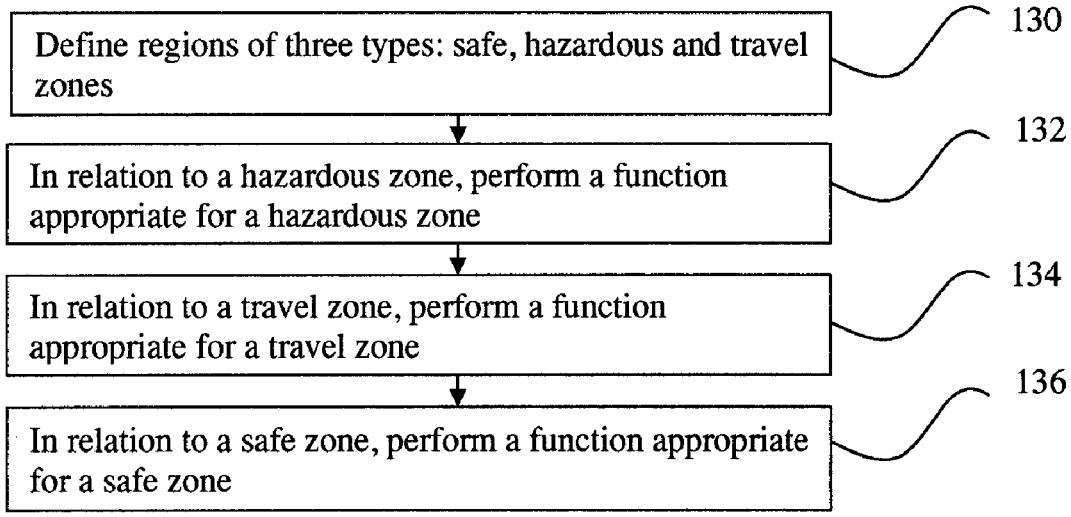
FIG. 7 is a flow chart showing the process of defining three different types of region and treating them differently.

In order to best satisfy the requirements of an industrial application in which assets may be in a hazardous zone, a safe zone, or in a travel zone in between a hazardous zone and a safe zone, in a preferred embodiment three different types of zones are defined and each of the three types of zone is treated differently. Referring to FIG. 7, in step 130 three types of region are defined. Preferably, the three types of region are safe, hazardous and travel zones, in which a safe zone includes an area or areas in which an asset may be present while off duty, a hazardous zone includes an area or areas in which an asset may be present while on duty, and a travel zone includes an area or areas in which an asset may be present while travelling between a safe zone and a hazardous zone. In step 132, in relation to a hazardous zone, a function appropriate to a hazardous zone is performed. This function may include counting the total number of assets in the zone, determining which assets are in the zone, initiating an alarm if an asset remains in the zone beyond a preset time period, or logging the entry and exit of assets into and out of the zone. In step 134, in relation to a travel zone, a function appropriate to a travel zone is performed. This function may include initiating an alarm if an asset remains stationary in the zone beyond a preset time period, or tracking the route of travel taken by an asset in the zone. In step 136, in relation to a safe zone, a function appropriate to a safe zone is performed. This function may include logging the entry and exit of assets into and out of the zone. It may also involve doing nothing at all. The person skilled in the art will readily recognize that the order of steps 132-136 is unimportant and they may all be carried out simultaneously.

As an example of a Geofence, a Geofence might have the parameters:

Location LSD=10-28-050-10 W5M

| | | |
|---|---|---|
| GPS coordinate | Latitude = 50.000 | Longitude = 90.000 |
| Geomatic Fence | Lat = 49.995 to 50.00 | Long = 89.995 to 90.005 |

A GPS Location may be configured with the following information:

LSD—legal land description

Location Size (e.g. 100 meters on a side/250 meters on a side/500 meters on a side/1 square km—depending on size of site. Likely preset in a separate table to provide consistency in defining Geofence areas)

GPS location—sent from a tracking device directly at a location.

Geofence—automatically calculated from the GPS location and perimeters based on the Location size.

A tracking device may be configured for an asset with the following information:

a number identifying the device, in an embodiment a SPoT ESN

Operator Name

Operator Company

Number of crewmembers

Operator regular contact phone number

Operator emergency contact phone number

Configuration of an asset to a GPS Location—standard times may be set that a specific asset would normally be on any one location. This will be used to set alarm times to trigger in the FPMI alarm summary. The information entered would be:

GPS Location

Operator

Standard site visit time

Site visit alarm time (equal to or greater than standard site visit time)

Below are listed some aspects of the utilization of the preferred embodiment:

Start of Day—Automated logging of movements in an embodiment in which SPoT is used as a tracking device:

Turn SPoT on.

Push the "ON/OFF" button until "ON/OFF" light flashes.

Place SPoT into "Track" mode

Push the "OK/Check" button until the "OK/Check" light goes from solid to flashing green.

End of Day—Logging off of system:

If in "Track" and you have received a "Safe_Zone_Enter" text, turn SPoT off.

If no "Safe_Zone_Enter" text received, turn SPoT off and turn back on.

Push the "OK/Check" button for one second, upon receiving a "Safe_Zone_Enter" text message turn SPoT off.

Note: There is no issue leaving SPoT in track 24 hours a day

In other embodiments, other methods may be used to automate tracking as would be obvious to a person of ordinary skill in the art.

Manually logging into a location from within the lease limits in an embodiment in which SPoT is used as a tracking device:

If in "Track" mode, turn SPoT off.

Turn SPoT on.

Push the "OK/Check" button for one second.

If not in "Track" mode, push the "OK/Check" button for one second, the OK/Check light will begin to flash green. The SPoT unit will have issued an OK signal when the "OK/Check" light goes solid green for 3 seconds and will turn off several minutes later.

Each "OK" extends the site timeout alarms as predefined by your administrator, extension times are not cumulative.

The operator will receive a confirmation text message that he is manually logged onto the site and how long his time has been extended for.

SPoT is to be put back into "Track" mode when the asset leaves the site.

In other embodiments, other methods may be used to manually log into a location as would be obvious to a person of ordinary skill in the art.

In an embodiment in which SPoT is used as a tracking device, batteries need replacing when the "ON/OFF" light flashes red. In other embodiments, other methods may be used to indicate a low battery as would be obvious to a person skilled in the art.

General Operating Procedures for SPoT GPS Transmitter:

Turning SPoT unit on:

Push the "ON/OFF" button until "ON/OFF" light flashes.

Turning SPoT unit off:

Push the "ON/OFF" button until the "ON/OFF" light stops flashing.

Placing SPoT unit into "TRACK" mode:

Turn "SPoT" unit on.

Push the "OK/Check" button until the "OK/Check" light goes from solid to flashing green. SPoT unit is now in "track" mode and will remain in track mode for 24 hours unless turned off, 911, Help or OK/Check buttons are pushed.

Every ten minutes the "OK/Check" light will turn solid green for 3 seconds when it is transmitting its GPS co-ordinates. After the 3 second transmission, the "OK/Check" light will return to its flashing state.

Removing SPoT unit from "TRACK" mode:

Turn "SPoT" unit off.

Placing SPoT unit into "HELP" mode:

Turn "SPoT" unit on.

Push the "HELP" button until the "HELP" light begins to flash green with the same flash time interval as the "ON/OFF light. The SPoT unit is now in "HELP" mode and will remain in help mode for 1 hour transmitting its GPS co-ordinates every 5 minutes.

"Help" mode can be activated at any time even when SPoT is other modes.

Removing SPoT unit from "HELP" mode:

Push the "HELP" button until the "HELP" light begins to flash red. When the "HELP Cancel" signal is sent the "HELP" light will turn solid red for 3 seconds and automatically turn off once the "HELP Cancel" is received. Do not turn off SPoT until HELP light turns off.

Placing SPoT unit into "911" mode:

Turn "SPoT" unit on.

Push the "911" button until the "911" light begins to flash green. The SPoT unit is now in "911" mode and will remain in 911 mode transmitting its GPS co-ordinates every 5 minutes until the 911 is cancelled or until the batteries are discharged.

"911" mode can be activated at any time even when SPoT is other modes.

Removing SPoT unit from "911" mode:

Push the "911" button until the "911" light begins to flash red. When the "911 Cancel" signal is sent, the "911" light will turn solid red for 3 seconds and automatically turn off once the "911 Cancel" is received. Do not turn off SPoT until 911 light turns off.

In other embodiments, other methods may be used to turn a tracking device on or off, to initiate and cease tracking, and to send and desist from sending help and emergency signals, as would be obvious to a person of ordinary skill in the art.

Figure 9:
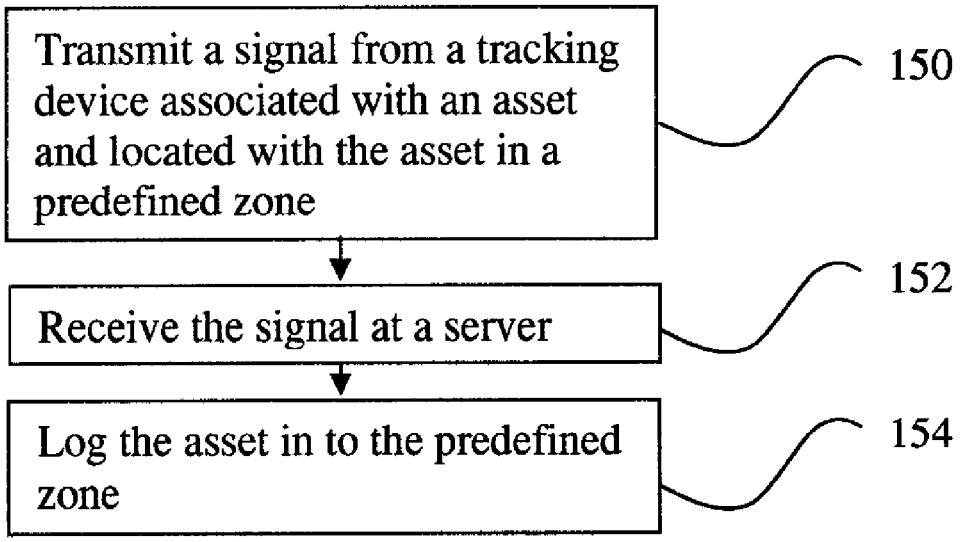
FIG. 9 is a flow chart showing the process of manually logging in to a zone.

Manual Mode Site Log In/Out Tracking:

The tracking system may include means for an operator or asset to manually log in or out of a zone. Referring to FIG. 9, in step 150 a signal is transmitted from a tracking device within a zone. The signal is received at a server in step 152, leading the server to log the asset into the zone in step 154 if the asset was not already logged in to the zone.

In the preferred embodiment, from within the actual location boundary (Geofence), the operator or asset will first issue a signal indicating the position from a tracking device, the receipt of this signal this will lead to an announcement in the log in/out summary on the FPMI host that the asset is actively on site.

Figure 10:
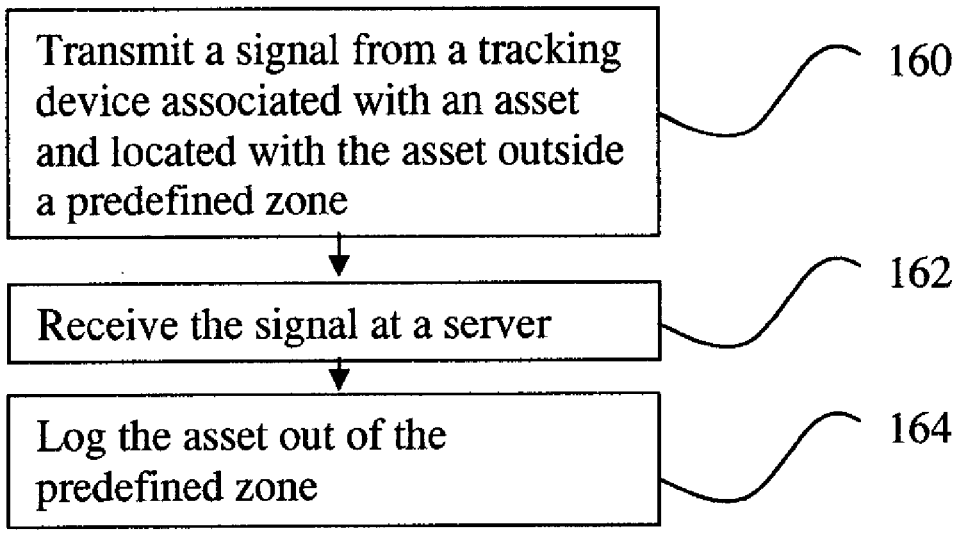
FIG. 10 is a flow chart showing the process of manually logging out of a zone.

Referring to FIG. 10, in step 160 a signal is transmitted from a tracking device outside of a zone. The signal is received at a server in step 162, leading the server to log the asset out of the zone in step 164 if the asset was previously logged in to the zone.

In an embodiment, once the asset leaves the location, the operator or asset will issue a signal indicating the position from a tracking device, the receipt of the signal will lead to an announcement in the log in/out summary on the FPMI host that the asset has left the site as long as they are outside the Geofence. Manual mode log/in out tracking may be particularly suited for contract operators but may be used by any operator or asset depending on the embodiment.

Automatic Mode Site Log in/Out Tracking:

Referring to FIG. 1, at the beginning of each day, the operator or asset will first issue a signal from a tracking device in step 20, for example in an embodiment an OK mode signal from SPoT. After the receipt of the signal in step 22 this will lead to an announcement in a log in/out summary on the FPMI host that the asset is active. Alternatively, the embodiment may avoid steps 20 and 22 and initiate directly from the position information from automatic tracking of the position of the tracking device, such as from the TRACK mode of SPoT, once automatic tracking of position is activated.

Once the signal is sent, the operator or asset activates automatic tracking of position by the tracking device, this enables the logging of the asset's movement automatically in steps 24-32 throughout the remainder of the day.

At the end of day, the operator or asset deactivates automatic tracking of position by the tracking device and a signal is sent, for example an OK mode signal from SPoT; when received at the server in step 32 this will log the asset out of the log in/out summary.

Automated Logging of Field Personnel Movement:

Still referring to FIG. 1, an asset carrying a tracking device set to automatically track position, for example periodically recording and transmitting the position, enters the GPS location. In step 24 position information would be sent to the server and is then retrieved from the server and compared in step 26 on a server's database which has a table mapping the GPS location to the actual LSD location to determine if the asset is in a predefined zone. If it is in the predefined zone and not already logged in to the zone, in the FPMI application, an active site summary would in step 28 log a number identifying the tracking device, and the asset to which it is assigned along with the time and date, this alarm summary would only show actively logged assets that are within GPS locations so at a glance the plant supervisor knows which assets are on any location. If it is not in the predefined zone, in step 30 the asset is removed from the active site summary if present. The asset's location in/out times are logged into a historical site summary which is archived for later viewing.

Alternatively the operator or asset may send a signal once the asset enters a location and as long as the asset is within the GPS location the active site summary will show it is on site, to manually log off the site the operator or asset sends another signal from outside the GPS location and as above the asset's status is moved from the active site summary to the historical site summary. This is meant as a means to track contract assets (such as maintenance personnel) that have no fixed schedule as to visiting locations and may be on locations for various periods of time.

Manually Logging Assets into Locations:

A supervisor may log the asset into the location with head count of crew, expected time on site (alarm when a follow up call needs to be made) and log in/out times. This is intended for use when assets do not have a tracking device.

The tracking devices may have text message receiving capability and receive text messages when the operator or asset logs in or logs out, or to alert the operator about warnings or alarms such as low battery or time out alarms. For a time out alarm, a warning message may be sent to the operator some time before the timeout. There may alternatively be a mobile communications device such as a cellular telephone or similar device associated with each operator such that a server can send text messages such as the types of message listed above to the mobile communications device. If no communication or response has been received from a tracking device when the asset associated with the device is supposed to be active, a message can be sent to the operator of the tracking device informing the operator that the tracking device is turned off. Text messages may also be used to inform an operator that tracking is active.

In an embodiment in which SPoT is used as a tracking device, each tracking device has an "OK/Check" button. Pressing and holding the button will put the device into "TRACK" mode. In "TRACK" mode the device will send a signal to a server indicating the position of the device every 10 minutes. In other embodiments, other methods may be used to activate automatic tracking of position as would be obvious to a person skilled in the art When the server receives a position signal from a tracking device in a safe zone and the device sending the signal had not sent a signal from the safe zone at a most recent signal indicating position within a period of time, either because the device had not transmitted a signal indicating the position of the device within the period of time, or because the device had been outside the safe zone, then the server sends a message to the operator of the device indicating that the operator has entered a safe zone. The message may include the position and a name of the safe zone. Similarly the server sends a message on receiving the first "track" signal when the asset has left a safe zone.

Pressing the "OK/Check" button also may cause the device to send a signal indicating the position of the device to the server. On receipt of this signal the server may send to the operator a message indicating the position of the device, the zone and type of zone in which the device is currently located, and the time remaining before any timeout alarms are initiated (such as the motionless travel or hazardous site timeout alarms). The signal may also cause the server to extend the time remaining until an alarm is initiated.

Figure 15A:
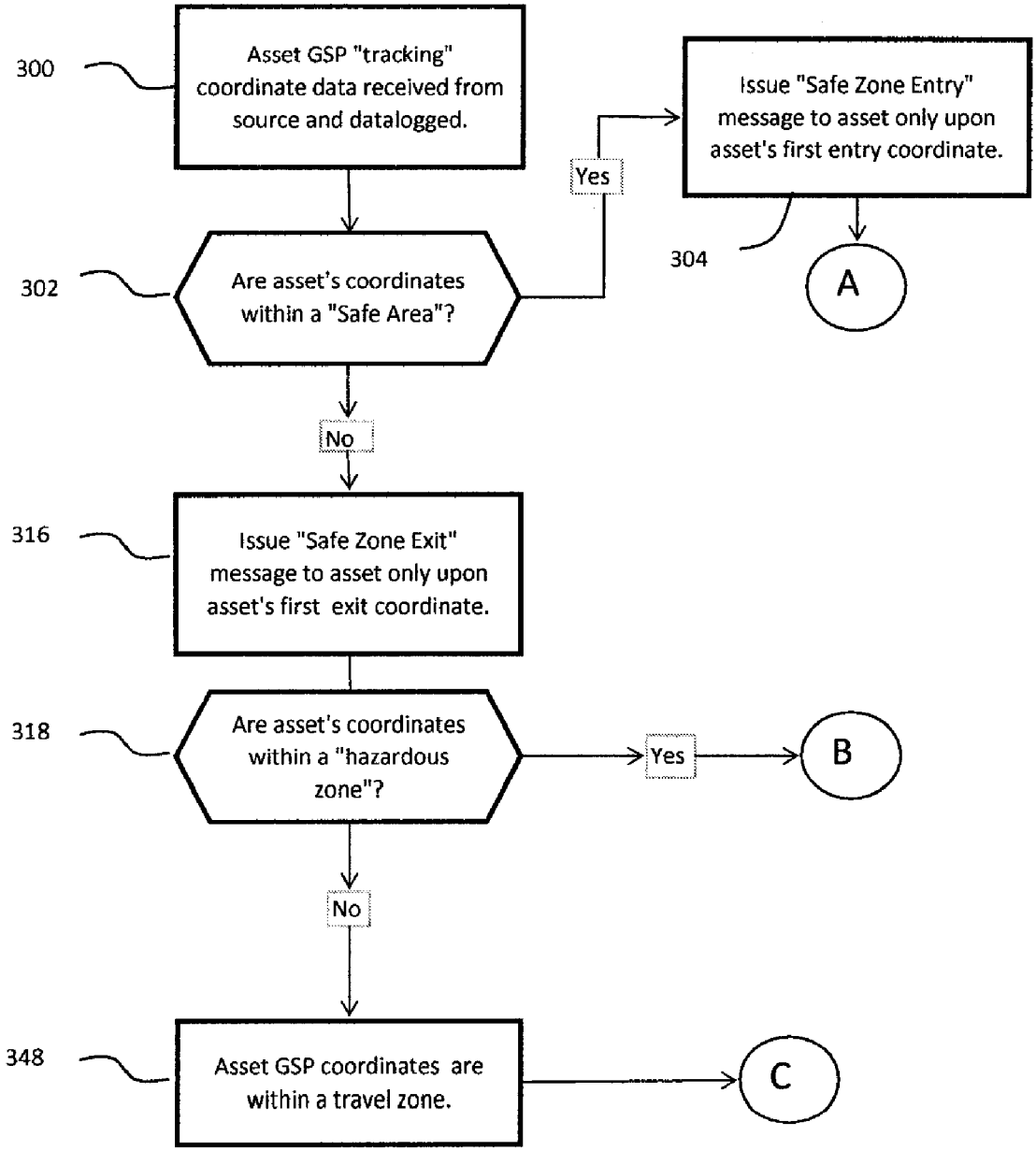
Figure 15B:
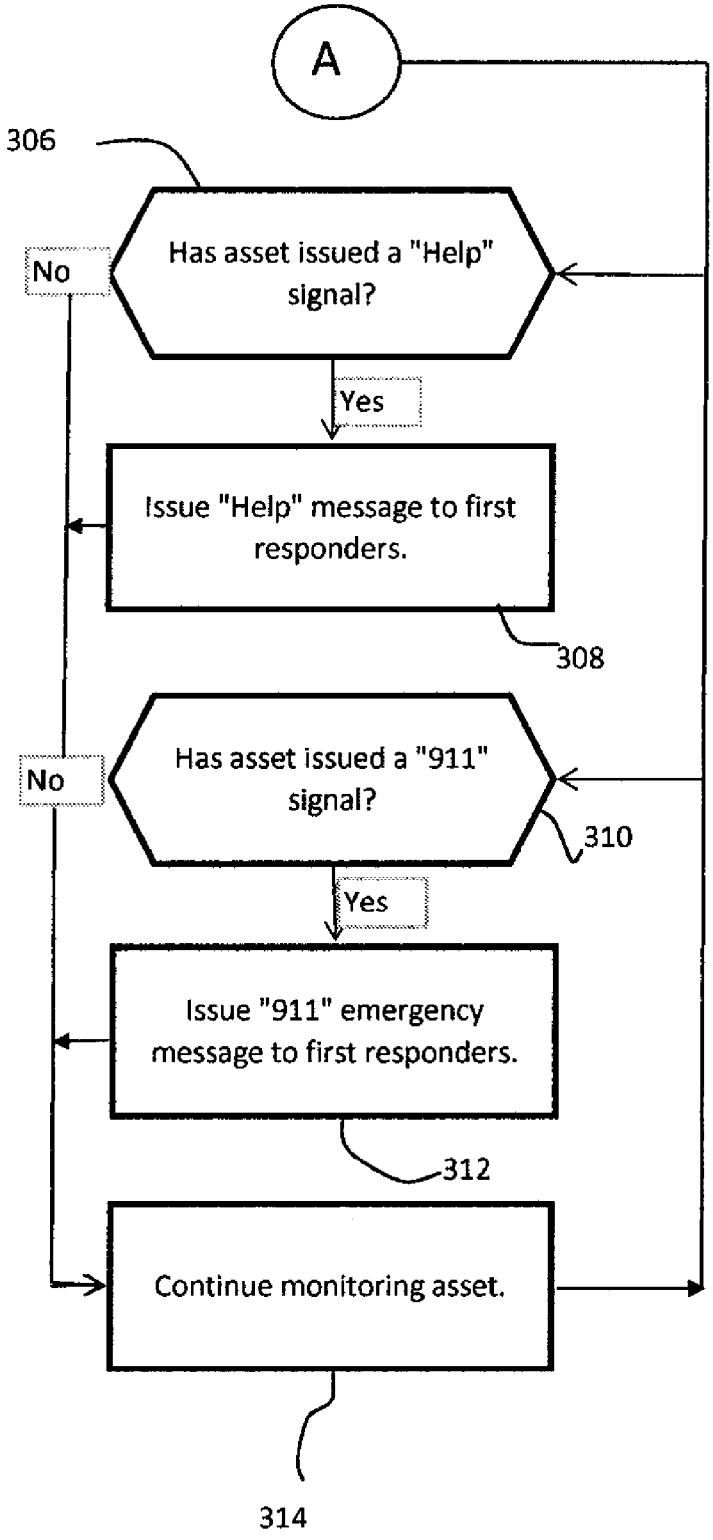
Figure 15C:
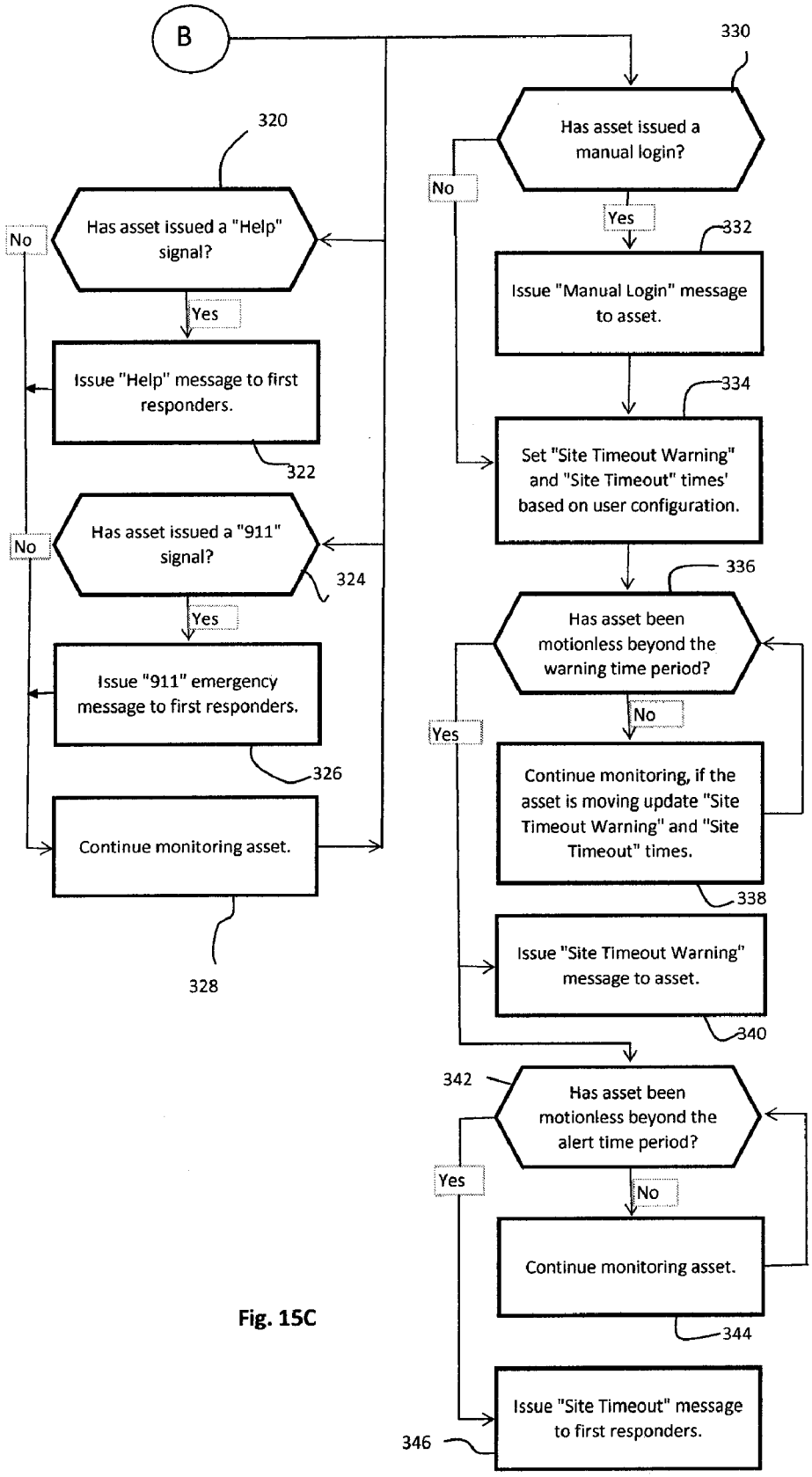
Figure 15D:
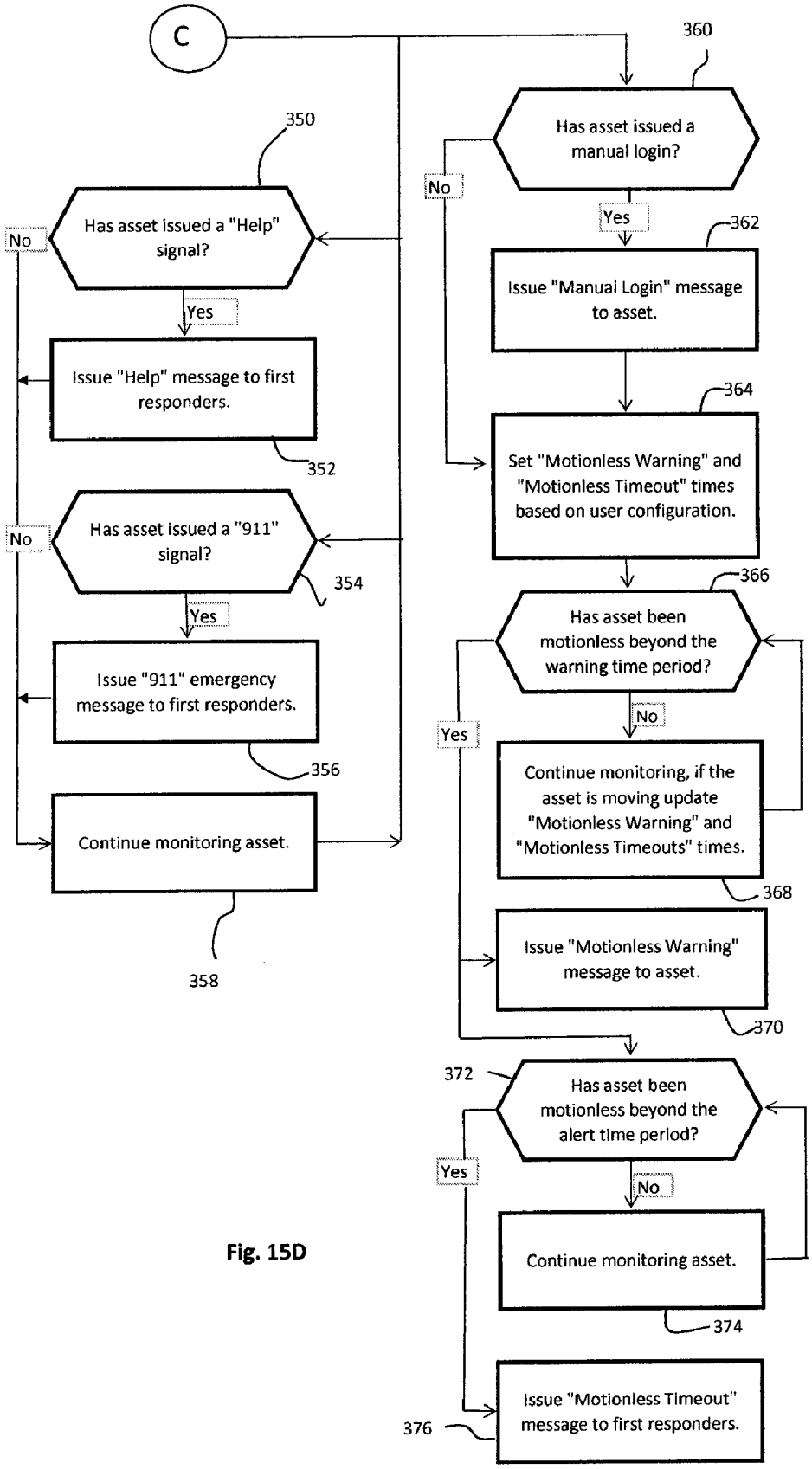

Referring to FIGS. 15A-15D, some aspects of the operation of an embodiment of a tracking system are shown. Referring to FIG. 15A, the tracking system receives position information concerning an asset in step 300. The system may record the position or position information of the asset for later use or reports. In step 302, the system determines whether the asset is in a safe area. If the asset is in a safe zone, then in step 304 the system issues a "Safe Zone Entry" message unless the asset has not been outside of a safe zone since a previous "Safe Zone Entry" message. Referring to FIG. 15B, in step 306 the system determines if the asset has issued a "Help" signal, and if so, in step 308 the system issues a "Help" message to first responders. In step 310 the system determines if the asset has issued a "911" signal, and if so, in step 312 the system issues a "911" message to first responders. Whether or not a help or 911 signal has been issued, in step 314 the system continues to monitor the asset. Referring to FIG. 15A, if the asset is not in a safe zone, then in step 316 the system issues a "Safe Zone Exit" message unless the asset has not been in a safe zone since a previous "Safe Zone Exit" message. In step 318 the system determines if the asset is in a "hazardous zone". If the asset is in a "hazardous zone", then referring to FIG. 15C, in step 320 the system determines if the asset has issued a "Help" signal, and if so, in step 322 the system issues a "Help" message to first responders. In step 324 the system determines if the asset has issued a "911" signal, and if so, in step 326 the system issues a "911" message to first responders. Whether or not a help or 911 signal has been issued, in step 328 the system continues to monitor the asset. In step 330 the system determines if the asset has issued a manual login, and if the asset has issued a manual login, then in step 332 the system issues a "Manual Login" message to the asset. In step 334 the system sets times at which site timeout alert and site timeout warning messages will be issued in the absence of further input. In step 336 the system determines if the time to issue the site timeout warning has arrived. If it has not, in step 338 the system will continue monitoring the asset, updating the times at which site timeout alert and site timeout warning messages are scheduled to be issued if the system receives information indicating movement or other information indicating that the asset is not in trouble such as, depending on the embodiment, an "OK mode" signal. If the time to issue a site timeout warning has arrived, then in step 340 the system will issue a "Site Timeout Warning" message unless the time at which a site timeout alert message is scheduled to be issued has not been updated since a previous "Site Timeout Warning" message was issued. In step 342, the system determines if the time scheduled to issue a site timeout alert message has arrived. If it has not, in step 344 the system will continue monitoring the asset, updating the times at which site timeout alert and site timeout warning messages are scheduled to be issued if the system receives information indicating movement or other information indicating that the asset is not in trouble such as, depending on the embodiment, an "OK mode" signal. The update may simply restore the time remaining until an alert or timeout is scheduled to be issued to the original value, or a more complicated logic may be followed, such as making extensions to the remaining time until an alert or timeout is issued not be fully cumulative. If the time to issue a site timeout alert has arrived, then in step 346 the system will issue a "Site Timeout" message to first responders. Referring to FIG. 15A, if in step 318 the system determines that the asset is not in a hazardous zone, then in step 348 the system determines that the asset is in a travel zone. FIG. 15D, the system then determines in step 350 if the asset has issued a "Help" signal, and if so, in step 352 the system issues a "Help" message to first responders. In step 354 the system determines if the asset has issued a "911" signal, and if so, in step 356 the system issues a "911" message to first responders. Whether or not a help or 911 signal has been issued, in step 358 the system continues to monitor the asset. In step 360 the system determines if the asset has issued a manual login, and if the asset has issued a manual login, then in step 362 the system issues a "Manual Login" message to the asset. In step 364 the system sets times at which motionless warning and motionless timeout messages will be issued in the absence of further input. In step 366 the system determines if the time to issue the motionless warning has arrived. If it has not, in step 338 the system will continue monitoring the asset, updating the times at which motionless warning and motionless timeout messages are scheduled to be issued if the system receives information indicating movement or other information indicating that the time should be extended such as, depending on the embodiment, an "OK mode" signal. The update may simply restore the time remaining until an alert or timeout is scheduled to be issued to the original value, or a more complicated logic may be followed, such as making extensions to the remaining time until an alert or timeout is issued not be fully cumulative. If the time to issue a site timeout warning has arrived, then in step 370 the system will issue a "Motionless Warning" message unless the time at which a motionless timeout message is scheduled to be issued has not been updated since a previous "Motionless Warning" message was issued. In step 372, the system determines if the time scheduled to issue a site timeout alert message has arrived. If it has not, in step 374 the system will continue monitoring the asset, updating the times at which motionless timeout and motionless warning messages are scheduled to be issued if the system receives information indicating movement or other information indicating that the time should be extended such as, depending on the embodiment, an "OK mode" signal. If the time to issue a motionless timeout has arrived, then in step 376 the system will issue a "Motionless Timeout" message to first responders. In the embodiment shown in FIGS. 15A-15D, hazardous zones and travel zones are treated differently in that warning and timeout times may be selected and updated differently for hazardous and travel zones. Depending on the embodiment, these differences may be merely quantitative, in that the length of time until a timeout or warning occurs may be different, or they may be qualitative, in that for example different inputs may trigger an update of warning and timeout times or a different logic is followed where a more complicated logic is used than simply restoring the remaining time to the original value. There may be further differences not shown in FIGS. 15A-15D, for example different reports as shown for example in FIG. 2 may be generated for different zones. In other embodiments there may be further differences in treatment.

In the particular embodiment of FIGS. 15A-15D, the system determines that an asset is in a travel zone if the asset is not in a safe zone or a hazardous zone. In other embodiments, the system may determine that an asset is in a hazardous zone if the asset is not in a safe zone or travel zone, or the system may determine that an asset is in a safe zone if the asset is not in a hazardous zone or travel zone. An active warning summary in a factory pmi application may annunciate that an asset has exceeded the site timeout alert time in a hazardous zone or that an asset has exceeded the motionless timeout time in a travel zone. In an embodiment, instead of setting a time at which for example a motionless timeout alert message will be issued and updating the time if movement is detected, the system may for example record information concerning the position of an asset over time and determine periodically from the recorded information whether an asset has been and remains motionless for a time sufficient that a motionless timeout alert message should be issued.

Optionally the time allowed for an asset to be on a site may be extended manually by the operator or asset (in the preferred embodiment, by sending in "OK mode" signals), or by detection of movement of the asset within the site. The amount by which the time can be extended in these ways, and the effect of further signals or detections of movement after the time has already been extended, can vary according to the embodiment or in an embodiment can be selected by a supervisor.

In the preferred embodiment, "Track" signals from a hazardous zone are data logged and data used to determine timeout warning and site timeouts. A message is sent to the operator if the asset has exceeded a warning time in the hazardous zone, normally less than the alarm time. When the alarm time is exceeded, a text message and/or an email message are sent to first responders, each message including an indication that the message is being sent due to a site timeout, an identification of the operator or asset or a tracking device associated with the asset, the position of the tracking device if applicable, and an indication of what zone the asset is in.

Figure 11:
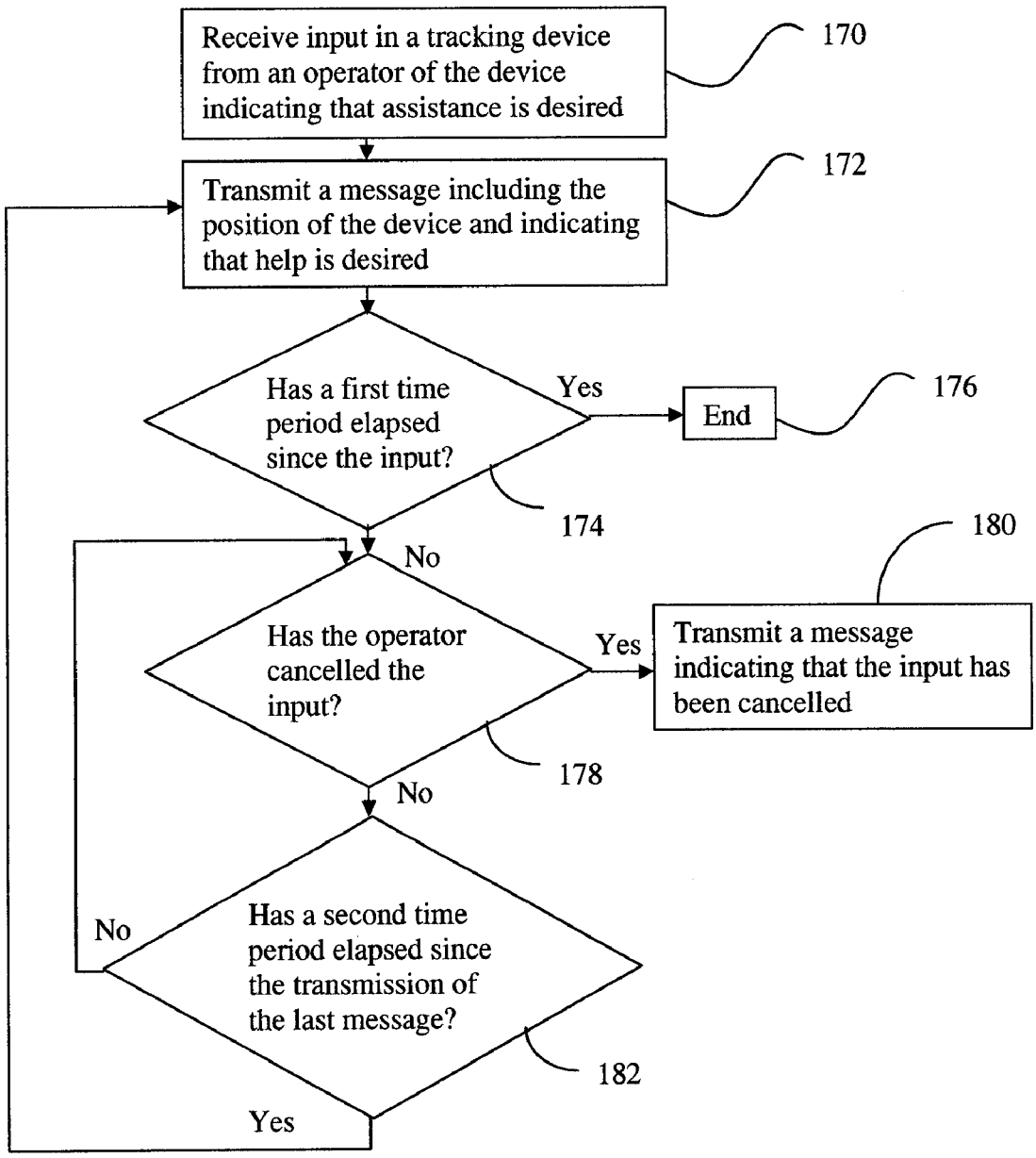
FIG. 11 is a flow chart showing the process of periodically transmitting messages if an operator or asset requests assistance.

If an operator of a tracking device desires assistance, or an asset encounters conditions in response to which it is programmed to request assistance using the tracking device, the device can periodically send a message including the position of the device. Referring to FIG. 11, in step 170 the device receives input from the operator or asset indicating that assistance is requested. In step 172 the device transmits a message indicating the position of the device and that help is requested. In step 174 if a first time period has elapsed, the device proceeds to in step 176 cease to periodically send messages; otherwise it proceeds to step 178. The determination that the first time period has elapsed may depending on the embodiment take the form of counting the number of messages transmitted. In step 178 if the operator or asset has cancelled the input, the device proceeds in step 180 to cease the process of periodically transmitting messages indicating the position and that help is requested, and sends a message indicating that the input has been cancelled. Otherwise the device proceeds to step 182. In step 182 if a second period of time has not elapsed since the last message indicating the position of the device and that help is requested was sent, the device will return to step 178, waiting for the time period to elapse or a cancellation of the input, and otherwise the device will return to step 172 to transmit the next message. Depending on the embodiment the messages periodically transmitted indicating that position and that help is requested may be sent to a server or directly to emergency responders. If they are sent to a server the server may then send messages to emergency responders.

Figure 12:
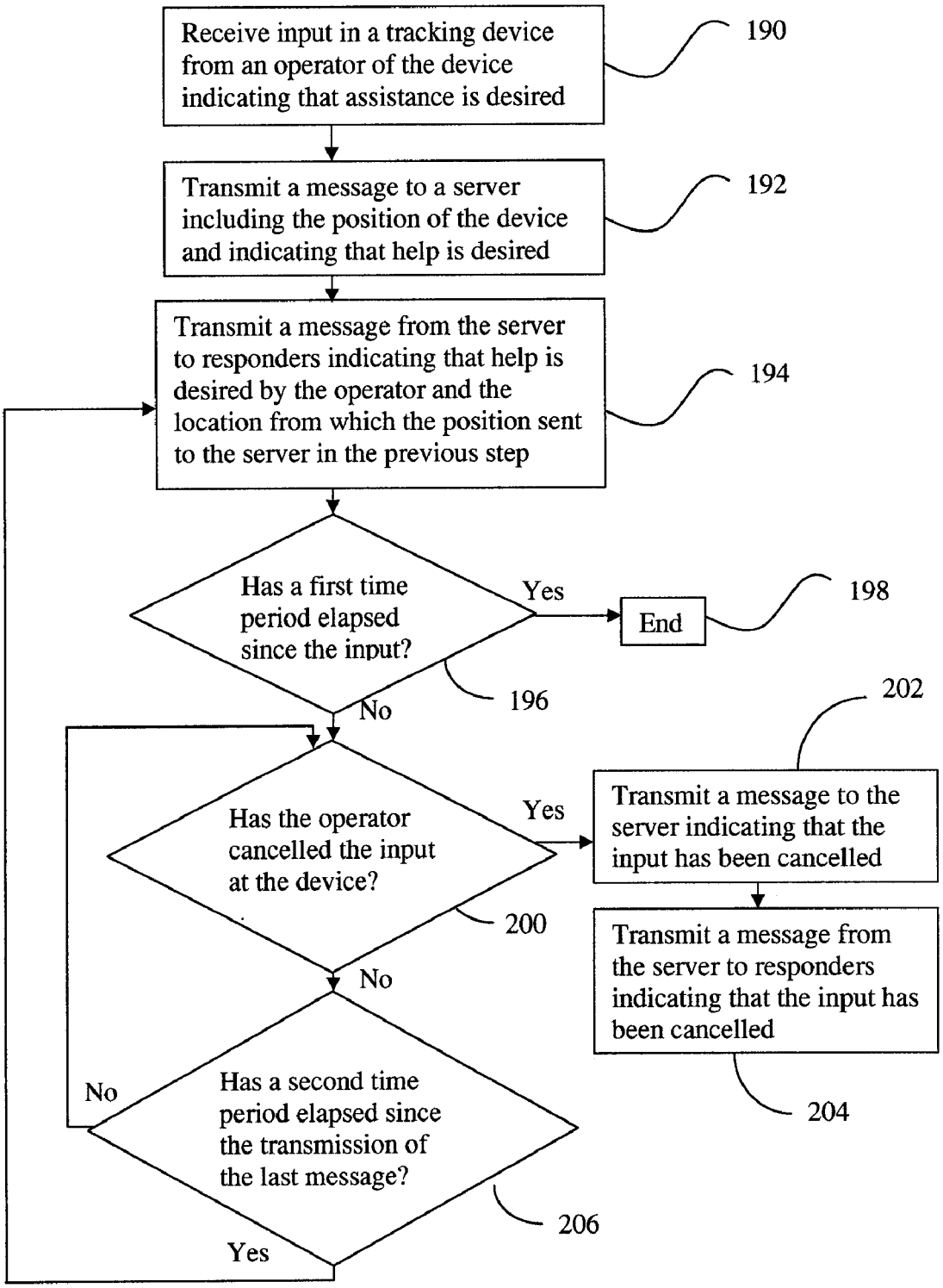
FIG. 12 is a flow chart showing an alternate method of periodically transmitting messages if an operator or asset requests assistance.

Alternatively a single message can be sent to a server, and the server can periodically send messages to emergency responders. Referring to FIG. 12, in step 190 the device receives input from the operator or asset indicating that assistance is requested. In step 192 the device transmits a message to a server indicating the position of the device and that help is requested. In step 194 the server transmits a message to emergency responders indicating that assistance has been requested by the operator or asset and the position indicated in the message sent to the server. In step 196 if a first time period has elapsed, the server proceeds to in step 198 cease to periodically send messages; otherwise the process continues at step 200. The determination that the first time period has elapsed may depending on the embodiment take the form of counting the number of messages transmitted. In step 200 if the operator or asset has cancelled the input, the device proceeds in step 202 to send a message to the server indicating that the input has been cancelled, and the server receiving the input proceeds in step 204 to cease the process of periodically transmitting messages indicating the position and that help is requested, and sends a message to responders indicating that the input has been cancelled. Otherwise the process continues at step 206 In step 206 if a second period of time has not elapsed since the last message indicating the position of the device and that help is requested was sent, the process returns to step 200, the server waiting for the time period to elapse or for a message from the device indicating cancellation of the input, and if the second time period has elapsed the process will return to step 194 in which the server transmits the next message.

Depending on the nature of the assistance requested, messages could be sent to other people than emergency responders, for example to supervisors or coworkers.

If it is desired to periodically transmit messages in response to an automatically detected criterion, the automatic detection of the criterion can substitute for the operator input. In this case an automatic detection that the criterion no longer holds may be used to substitute for the operator's cancellation of the input.

In the preferred embodiment procedure described above and shown in FIG. 12 takes two forms, HELP mode in which the first time period is 1 hour and the second time period is 5 minutes, and 911 mode in which the first time period is indefinitely long and the second time period is 5 minutes. The messages sent in the preferred embodiment indicate which of the HELP mode or 911 mode is active. In an embodiment the first and second time periods and the information in the messages sent may depend on whether the device is in a safe, travel or hazardous zone, but there is no such dependence in the preferred embodiment. Depending on the embodiment, the 911 button may cause the tracking device to send messages directly to a preselected list of recipients or to send a message to a server which sends messages to a list of recipients.

In an embodiment an operator or asset in a non-emergency situation may send a help signal from a tracking device, this will cause an immediate message displaying the identifying number of the tracking device and the operator who it is assigned to along with the time and date to appear in the active alarm summary in the fpmi application.

In an embodiment an operator or asset in an emergency situation may transmit an emergency signal using a tracking device, this will cause an immediate message displaying the identifying number of the tracking device and the operator who it is assigned to along with the time and date to appear in the active alarm summary in the fpmi application.

In an embodiment each tracking device will send a signal on detecting a low battery to annunciate a low battery alarm at the host.

In an embodiment the host will annunciate an alarm upon loss of data feed from the server.

Figure 2:
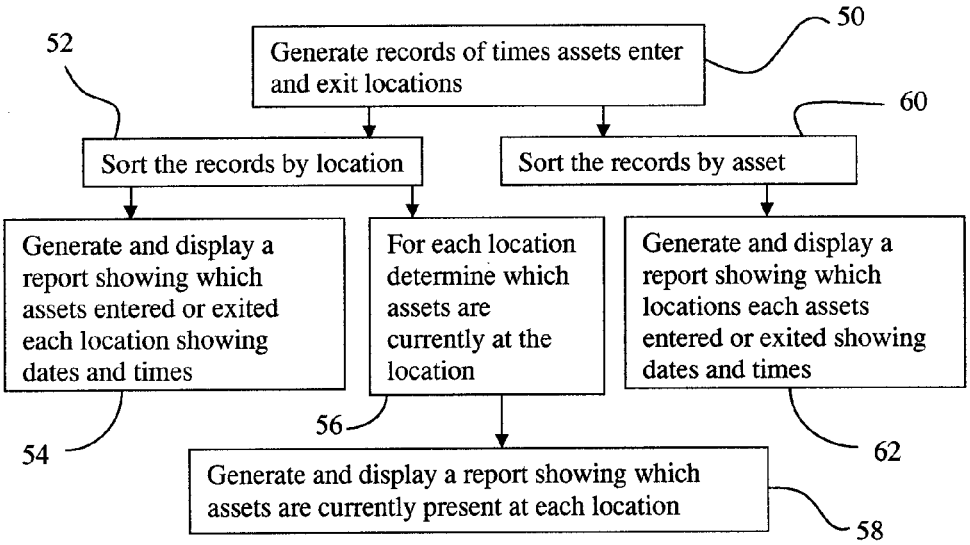
FIG. 2 is a flow chart showing the process of generating reports concerning assets' activities relative to locations.
Figure 3:
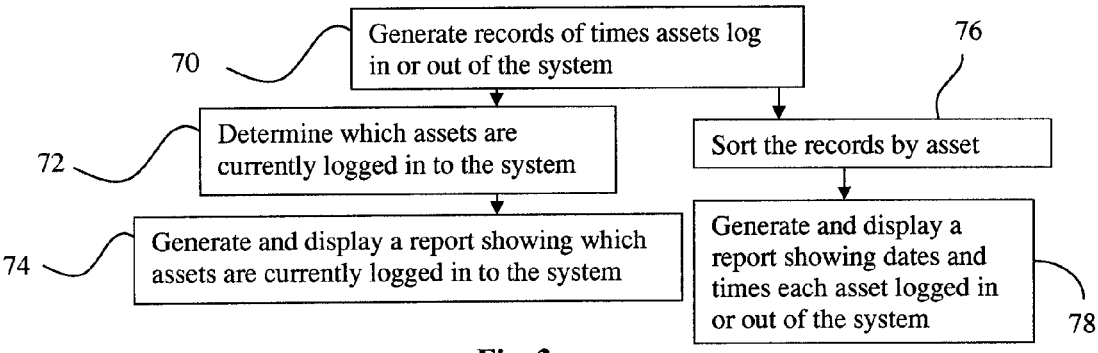
FIG. 3 is a flow chart showing the process of generating reports concerning assets' activities relative to the overall system.

Referring to FIG. 2, in the preferred embodiment the host provides reports to a supervisor. In FIG. 2 and FIG. 3, where multiple arrows leave a step the arrows should all be followed, either sequentially or in parallel. In step 50 data concerning the times that assets entered and exited locations is collected and recorded, for example using the "automatic mode site log in/out tracking" described above, but manual logging of an asset in and out of sites by an operator or asset or manual logging of an asset in and out of sites of by a supervisor could also be used. The data collected in step 50 is sorted by location in step 52 to generate and display a report in step 54 showing which assets entered or exited each location with dates and times. The assets currently in each location are also determined in step 56 to generate and display a report in step 58 showing the assets present at each location. A person skilled in the art will recognize that the determination of which assets are currently in a location could be made directly using the records of step 50 or the records of step 50 sorted according to step 52 or using a record of which assets are present in each location that is immediately updated when assets enter and exit locations, or a combination of these methods such as using a record of which assets are at each location that is periodically updated using data that has been collected in step 50 since the previous update of the record. The data from step 50 is sorted according to the asset in step 60 to generate and display a report in step 62 showing which locations the asset entered or exited and the dates and times of entry and exit.

Referring to FIG. 3, similar reports can analogously generated and displayed from data concerning the times assets logged in or out of the overall system as from the data concerning the times assets entered and exited locations. In step 70 data concerning the times that assets logged in or out of the system is collected and recorded. In step 72 it is determined which assets are currently logged in to the system, and from this information a report is generated and displayed in step 74 showing which assets are logged on to the system. A person skilled in the art will recognize that the same variety of methods that can be used in step 56 can also be used in step 72. In step 76 the data from step 70 is sorted according to the asset to generate and display a report in step 78 showing at what times and dates each asset has logged in or out of the system.

Figure 6:
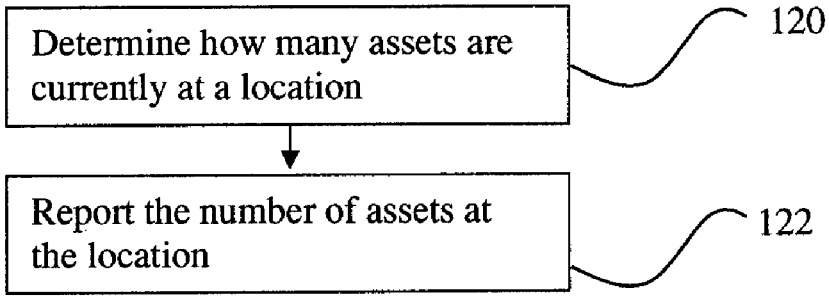
FIG. 6 is a flow chart showing the process of determining the total number of assets at a location.

Referring to FIG. 6, in step 120 it is determined how many assets are currently at a location, for example by counting the assets found to be at the location in step 56, or counting the number of assets logging in to a location minus the number logging out. In step 122 the number of assets at the location is reported. This is particularly useful for a hazardous zone, as supervisors may wish to know the total number of assets on site.

Figure 4:
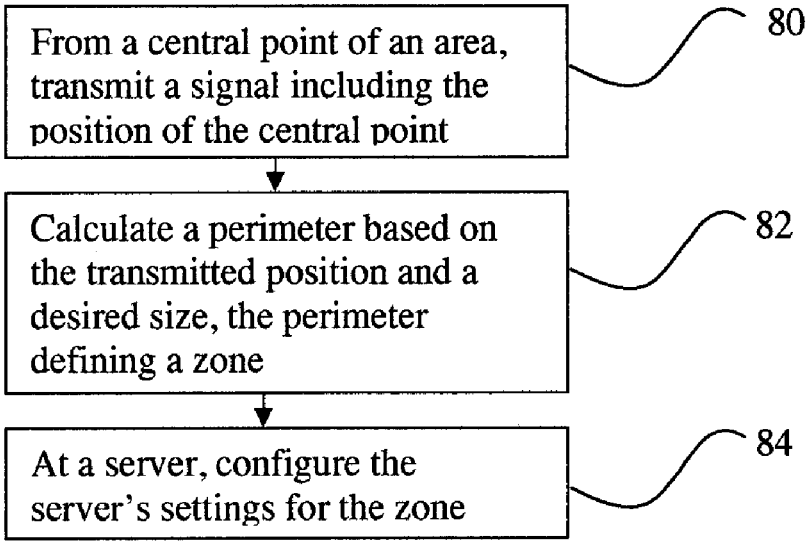
FIG. 4 is a flow chart showing the process of setting up a Geofence zone.

Initial Setup of Locations:

Referring to FIG. 4, to setup a location with a Geofence in an embodiment:

- In step 80 travel to the LSD and issue an OK mode signal from a central point on the location, the position indicated by this signal is the "GPS location"
- In step 82 calculate the Geofence perimeter using the intended size of the Geofence area and the central point
- In step 84 configure the GPS location in the host. (ideally from notebook over wireless at site or call to host at office and configure GPS location)
- verify that the automatic log in/out functions at site work either manually or in track mode.

In another embodiment, the boundary of a location may be recorded by for example recording the position of the corners of the location.

Figure 5:
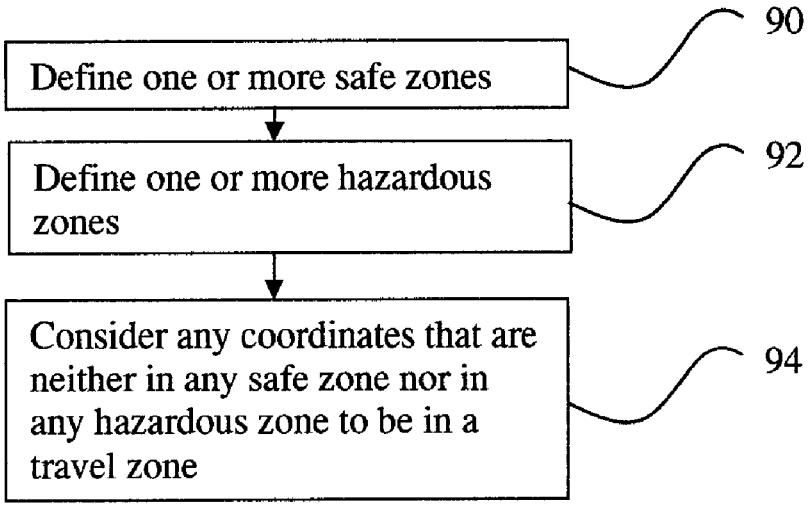
FIG. 5 is a flow chart showing how travel zones are defined in the preferred embodiment.

Referring to FIG. 5, travel zones can also be defined as all territory that is not part of a hazardous zone or a safe zone. In step 90 one or more safe zones is defined, and in step 92 one or more hazardous zones are defined. The safe zones and hazardous zones may be defined in any order. Then in step 94 all territory that is not part of the safe zone or zones and hazardous zone or zones defined in steps 90 and 92 is considered to be a travel zone for the purposes of e.g. tracking motion of an asset through the zone or detecting that an asset has remained stationary in the zone for longer than allowed, as described below. If more safe zones or hazardous zones are added later, the travel zone can again be defined as all territory that is not part of a hazardous zone or a safe zone.

Figure 8:
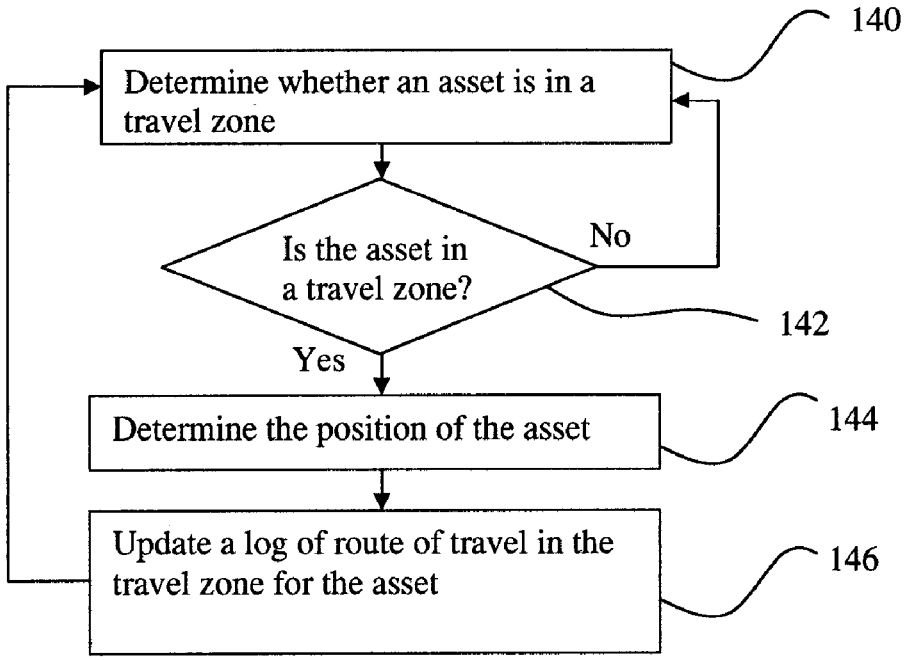
FIG. 8 is a flow chart showing the process of logging the route of travel of an asset through a travel zone.

Referring to FIG. 8, the route of travel of an asset in a travel zone may be logged. In step 140 it is determined whether an asset is in a travel zone. This determination may be done by determining the position of the asset and comparing the position of the asset to a table of zone definitions, or it may be done by determining what zone the asset is logged into. In step 142 the system proceeds with the process of logging the route of travel in a travel zone depending on whether the asset is in a travel zone. In step 144 the position of the asset is determined. If the position of the asset was already determined in step 140, then that determination of the position of the asset may be used. In step 146 a log of the route of travel of the asset is updated using the determination of the position of the asset from step 144. If there is not already a log of the route of travel of the asset in the travel zone, the step of updating the log may involve creating it.

In an embodiment in which SPoT is used as a tracking device, track signals are received every 10 minutes from tracking devices in "track" mode. Track signals received from a travel zone are logged as described above and used to determine motionless travel alarms as described above in the description of FIGS. 15A-15D, particularly 15D. In other embodiments, a tracking device may have an automatic tracking mode in which the tracking device transmits signals indicating the position of the device according to specified criteria, for example periodically.

In the preferred embodiment, when in a travel zone and the asset remains motionless beyond the preset time, a server sends a text message to first responders repeated every 30 minutes indefinitely until the asset moves as detected by a track signal or manually logs in with an ok signal, the message including the position of motionless travel, an identification of the device or operator or asset, and the fact that the message is concerning motionless travel. An email message including the same information is also sent to first responders repeated every 30 minutes for 2 hours.

An embodiment also includes a global alert function which provides the following upon receiving an alert from any lone worker:

a. Automatically determine all first responders that are available within a pre-determined area of the alert.
b. Automatically issue information to all first responders the position of the emergency.

Immaterial modifications may be made to the embodiments described here without departing from what is covered by the claims.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method of configuring a tracking system with one or more tracking devices each associated with an asset, the method comprising:

defining at least a region of a first type;

defining at least a region of a second type;

defining at least a region of a third type;

configuring the tracking system to perform at least a first function relating to the second type of region, the first function being one of a class of functions consisting of:

A) initiating an alarm if a tracking device associated with an asset remains within the region of the second type for a time exceeding a first preset time duration; and B) logging a total number of tracking devices each associated with an asset in the region of the second type; and configuring the tracking system to perform at least a second function relating to the third type of region, the second function being one of a class of functions consisting of:

C) initiating an alarm if a tracking device associated with an asset remains stationary within the region of the third type for a time exceeding a second preset time duration; and D) tracking a route of travel of a tracking device while it remains within the region of the third type.

2. The method of claim 1 further comprising the step of configuring the tracking system to record times at which any tracking device associated with an asset enters or exits the region of the first type.

3. The method of claim 1 further comprising the step of configuring the tracking system to record times at which any tracking device associated with an asset enters or exits the region of the second type.

4. The method of claim 1 in which the at least the region of the first type corresponds to an area or areas in which an asset is present when off duty, the at least the region of the second type corresponds to an area or areas in which an asset is present while on duty, and the at least the region of the third type corresponds to an area or areas through which an asset travels between the region of the first type and the region of the second type.

5. The method of claim 1 in which the at least a region of the first type corresponds to an area or areas in which the asset is present while off duty.

6. The method of claim 1 in which the at least a region of the second type corresponds to an area or areas in which the asset is present while on duty.

7. The method of claim 1 in which the at least a region of the third type corresponds to an area or areas between the at least a region of the first type and the at least a region of the second type.

* * * * *